US009033544B2

(12) United States Patent
Yan

(10) Patent No.: US 9,033,544 B2
(45) Date of Patent: May 19, 2015

(54) SMOOTH LED PAR LAMP

(71) Applicant: Technical Consumer Products, Inc., Aurora, OH (US)

(72) Inventor: Ellis Yan, Aurora, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 140 days.

(21) Appl. No.: 13/866,577

(22) Filed: Apr. 19, 2013

(65) Prior Publication Data

US 2014/0313730 A1 Oct. 23, 2014

(51) Int. Cl.

| | |
|---|---|
| ***F21V 17/00*** | (2006.01) |
| ***F21V 29/00*** | (2006.01) |
| ***F21K 99/00*** | (2010.01) |

(52) U.S. Cl.

CPC ..... *F21V 29/22* (2013.01); *F21K 9/1375* (2013.01); *F21V 29/70* (2015.01)

(58) Field of Classification Search

CPC ..... F21V 15/01; F21V 23/02; F21V 29/20; F21V 7/0083; F21V 7/09; F21V 2101/02; F21Y 2101/02; F21Y 2103/003; G02B 23/12; G02B 3/00; G02B 5/00; G02B 7/00; G02B 19/00; H05K 1/14; H05K 1/00; G09F 13/00

See application file for complete search history.

(56) References Cited

U.S. PATENT DOCUMENTS

| | | | | |
|---|---|---|---|---|
| 7,824,075 | B2 * | 11/2010 | Maxik | 362/294 |
| 8,324,789 | B2 * | 12/2012 | Hisayasu et al. | 313/46 |
| 8,354,783 | B2 * | 1/2013 | Takenaka et al. | 313/318.07 |
| 8,579,470 | B1 * | 11/2013 | Leahy et al. | 362/249.02 |
| 8,602,579 | B2 * | 12/2013 | Van de Ven et al. | 362/96 |
| 8,746,920 | B2 * | 6/2014 | Chen | 362/188 |
| 8,770,821 | B2 * | 7/2014 | Ijzerman et al. | 362/628 |
| 2009/0323305 | A1 * | 12/2009 | Deng | 362/84 |
| 2010/0096992 | A1 | 4/2010 | Yamamoto et al. | |
| 2010/0109499 | A1 | 5/2010 | Vilgiate et al. | |
| 2011/0050133 | A1 | 3/2011 | Grajcar et al. | |
| 2012/0212129 | A9 | 8/2012 | Chou et al. | |
| 2013/0016509 | A1 * | 1/2013 | Van de Ven | 362/235 |
| 2013/0082600 | A1 * | 4/2013 | Ter-Hovhanissian | 315/112 |

FOREIGN PATENT DOCUMENTS

| | | |
|---|---|---|
| CN | 202868630 | 4/2013 |
| WO | 2013/055388 | 4/2013 |

OTHER PUBLICATIONS

PCT, International Search Report and Written Opinion, PCT/US2014/034616 (Aug. 22, 2014).

* cited by examiner

*Primary Examiner* — Hargobind S Sawhney
(74) *Attorney, Agent, or Firm* — Thompson Hine LLP

(57) ABSTRACT

An LED lamp includes an LED assembly including a plurality of LEDs. The LED lamp includes a circular base plate in thermal communication with the LED assembly. The LED lamp includes an electrical module electrically coupled to the LED assembly and configured to supply power to the LED assembly. The LED lamp includes a lamp body coupled to and in thermal communication with the base plate at a first end and concealing at least a portion of the electrical module at a second end. The lamp body includes a substantially smooth surface extending from the base plate to the electrical module. The Led lamp includes an optic configured to disperse light generated by the LED assembly.

15 Claims, 2 Drawing Sheets

SMOOTH LED PAR LAMP

FIELD OF DISCLOSURE

The present disclosure relates to the field of lamps. More particularly, the present disclosure relates to LED PAR lamps.

BACKGROUND

Incandescent or halogen parabolic aluminized reflector lamps, also known as PAR lamps, produce an intense pool of focused light. As a result, PAR lamps are commonly used in a variety of applications, including commercial and residential. Incandescent and halogen bulbs, however, may be less efficient and less effective than an LED bulbs, and are therefore commonly replaced with more efficient and more effective LED bulbs.

An LED light source, however, is more compact in size and the lumen output is more sensitive to operating temperature. An LED lamp may therefore require heat dissipating features for adequately dissipating heat to prevent the LED from overheating and failing, which an incandescent lamp may not require. However, incorporating into the design of a PAR lamp a heat dissipating features, such as a heat sink with fins surrounding the outside of the heat sink or surrounding the optic at the surface of the lamp, alters the appearance of the PAR lamp which may not be desirable.

SUMMARY OF THE DISCLOSURE

An LED lamp includes an LED assembly including a plurality of LEDs. The LED lamp includes a circular base plate in thermal communication with the LED assembly. The LED lamp includes an electrical module electrically coupled to the LED assembly and configured to supply power to the LED assembly. The LED lamp includes a lamp body coupled to and in thermal communication with the base plate at a first end and concealing at least a portion of the electrical module at a second end. The lamp body includes a substantially smooth surface extending from the base plate to the electrical module. The Led lamp includes an optic configured to disperse light generated by the LED assembly. The LED lamp includes a transparent optic holder surrounding the optic, coupled to the first end of the lamp body, and configured to support the optic. The transparent optic holder has an outer circumference substantially equal to a circumference of the first end of the lamp body and an inner circumference substantially equal to a circumference of the optic.

A PAR lamp includes an LED module including a plurality of LEDs. The PAR lamp includes an electrical module configured to supply power to the LED module. The PAR lamp includes a heat sink assembly including a thermally conductive base and a smooth-surfaced thermally conductive body. The LED module is in thermal communication with and coupled to a first side of the thermally conductive base. The electrical module is coupled to a second side of the thermally conductive base, opposite the LED module. The smooth-surfaced thermally conductive body is configured to extend the length of the heat sink, from the thermally conductive base to the electrical module, and to conceal at least a portion of the electrical module. The PAR lamp also includes an optic module coupled to the first side of the smooth-surfaced thermally conductive body and having an outer circumference substantially equal to a circumference of the first side of the smooth-surfaced thermally conductive body. The optic module includes an optic configured to disperse light generated by the LED module and a transparent ring surrounding the optic.

BRIEF DESCRIPTION OF THE DRAWINGS

In the accompanying drawings, structures are illustrated that, together with the detailed description provided below, describe exemplary aspects of the present teachings. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1B:
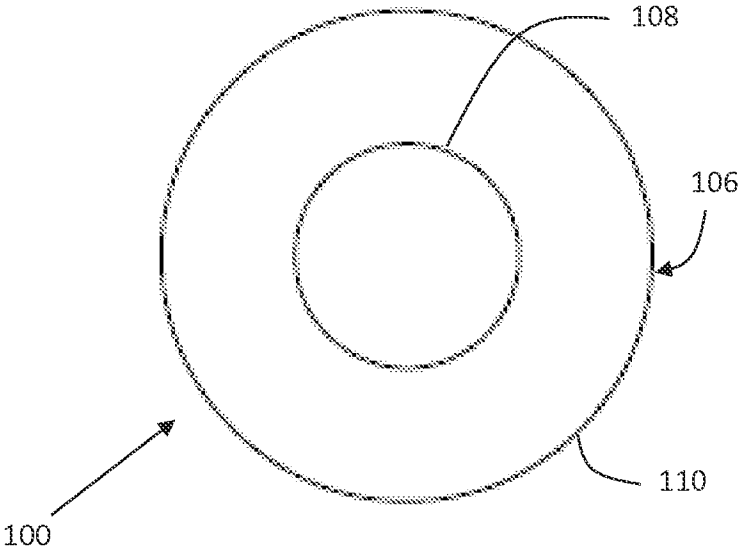
FIG. 1B illustrates a top view of an example smooth LED PAR lamp.
Figure 1A:
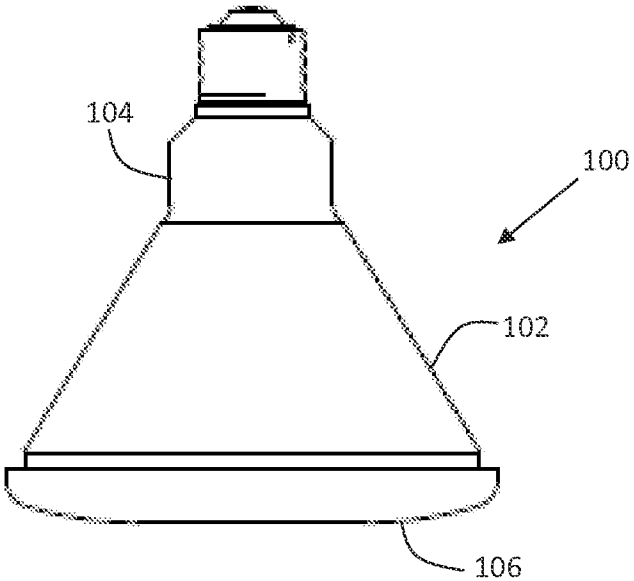
FIG. 1A. illustrates a side view of an example smooth LED PAR lamp.

FIG. 1A illustrate a side view of an example smooth LED PAR lamp 100 (hereinafter referred to as lamp). Lamp 100 includes a lamp body 102 that extends from an electrical module 104 to an optic assembly 106. Lamp body 102 has a smooth surface, meaning it does not include any fins, ridges, or any other protruding elements. Lamp body may be constructed of thermo-plastic, plastic, aluminum, or other suitable material capable of dissipating heat away from lamp 100.

FIG. 2B illustrates a top view of lamp 100 including optic assembly 106. Optic assembly 106 includes an optic 108 for dispersing light generated by lamp 100. Optic assembly 106 also includes an optic holder 110 that surrounds optic 108 and supports optic 108. Optic holder 110 is either transparent or semi-transparent. Optic holder 110 can be made of plastic, glass, or other suitable transparent or semi-transparent material.

Optic assembly 106 covers the entire top surface of lamp 100. In other words, no fins, ridges or any other elements are exposed at the top of lamp 100, other than optic assembly 106. In addition, because optic holder 110 is either transparent or semi-transparent, optic assembly 106 covering the entire top surface of lamp 100 creates the appearance of light being dispersed across the entire surface of lamp 100, even though the center portion, or optic 108, is the only portion of optic assembly 106 is dispersing light.

Optic holder 110 may be smooth or textured. Additionally, optic assembly 106 may be manufactured as a single structure including both optic 108 and optic holder 110 or optic assembly 106 may be manufactured as two independent pieces that fit together, as is illustrated in FIG. 2.

Figure 2:
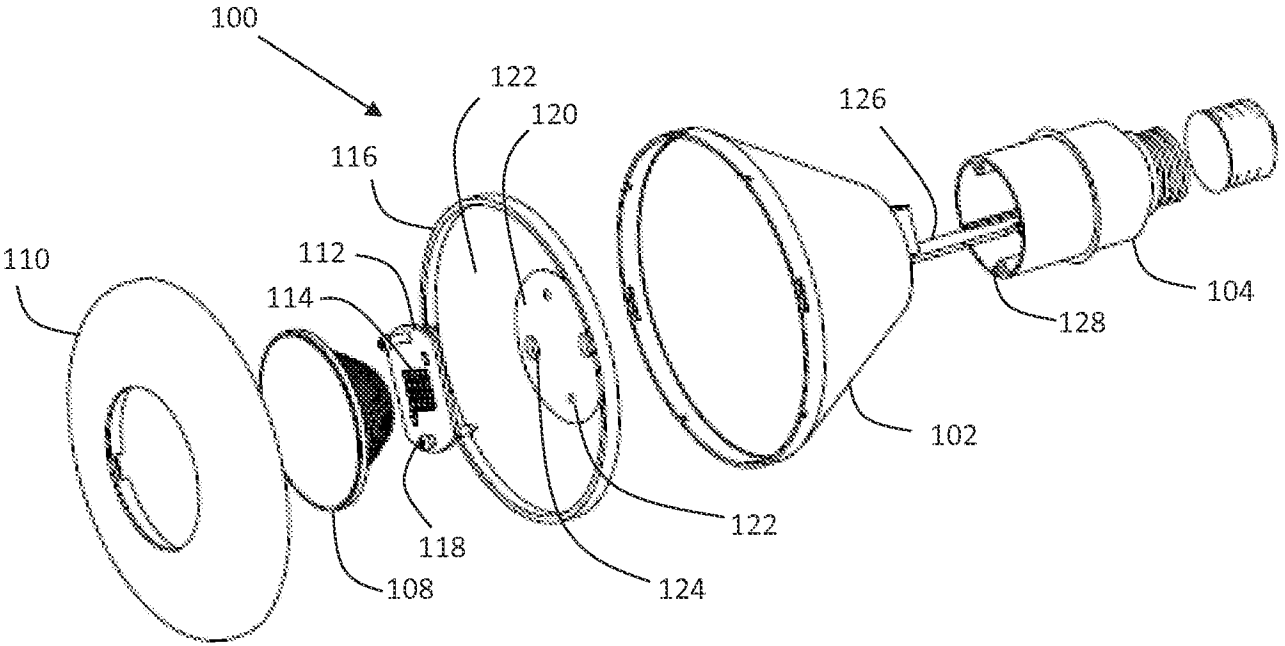
FIG. 2. Illustrates an exploded isometric view of an example LED PAR lamp.

FIG. 2 illustrates an exploded isometric view of the example lamp 100 of FIGS. 1A and 1B. Lamp 100 has an LED assembly 112 which includes a group of LEDs 114 for generating light. LED assembly 112 is secured to a base plate 116 at a first side, or at a top side. Although LED assembly 112 is secured to base plate 116 using mounting hardware 118 in the example illustrated, it should be understood that LED assembly 112 may be secured to base plate 116 using an adhesive or with other suitable means. Although the example base plate 116 is illustrated as being circular, base plate 116 may include other suitable shapes.

Base plate 116 is made of a material that can dissipate heat into surrounding air, such as a thermo plastic, aluminum or other suitable material. Accordingly, base plate 116 is in thermal communication with LED assembly 112 and acts to dissipate heat away from LED assembly 112 when in contact with LED assembly 112. In one example, base plate 116 has a flat center region 120 and a sloping outer region 122. Flat center region 120 may have hardware holes 122 for receiving mounting hardware 118. Base plate 116 also has one or more wire holes 124 for receiving wires 126 and other suitable electrical connections made between electrical module 104 and LED assembly 112. In one example, electrical module 104 includes mounting holes 128 for receiving mounting hardware 118. Accordingly, electrical module 104 may be secured to an end of base plate 116, opposite to LED assembly 112. In another example, electrical module 104 may be configured to snap in to lamp body 102.

Lamp body 102 is connected to base plate 116 at a first end of lamp body 102. Base plate 116 has a circumference substantially equal to the circumference of a top end of the lamp body 102. Accordingly, lamp body 102 and base plate 116 form a tight fit, or connection, so that heat is transferred from base plate 116 to lamp body 102, and thereafter dissipated to surrounding air. In one example, base plate 116 is configured to snap into the lamp body 102 and securely connect to lamp body 102 without additional hardware or adhesive material. In one example, hardware may be used (not shown) or adhesive material may be applied (not shown) to secure base plate 116 to lamp body 102. In one example, lamp body 102 and base plate 116 are manufactured as a single structure, and therefore a mechanical connection is not required.

In the example illustrated, lamp body 102 is cone-shaped meaning that the circumference of the first end of lamp body 102, or the top, is greater than the circumference of the second end of lamp body 102, or the bottom. It another example, lamp body 102 may be cylindrical shaped such that the circumference at the top is the substantially the same as the circumference at the bottom.

Lamp body 102 conceals wires 126 and other suitable electrical connections made between electrical module 104 and LED assembly 112. Lamp body 102 has a circumference at the bottom that is substantially the same as the circumference of the electrical module 104. Lamp body 102 overlaps with and conceals at least a portion of electrical module 104. Lamp body 102 also overlaps with and conceals at least a portion of base plate 116. Thus, the smooth surface of lamp body 102 extends from base plate 116 to electrical module 104, giving lamp 100 a smooth appearance without any fins, ridges, or other elements protruding from lamp 100.

In one example, flat center region 118 is depressed, or indented into the hollow center of lamp body 102. This indentation provides sufficient room for positioning optic 108 above LED assembly 112 so that optic 108 may disperse light generated by LEDs 114. In one example, LEDs 114 of LED assembly 112 are arranged right up against one another or adjacent to one another. Positioning LED's closely together reduces the surface area of the LED assembly 112 which reduces the depth requirement of optic 108.

Lamp 100 includes a transparent optic ring, or holder 110 surrounding optic 108 and coupled to the first end, or the top of lamp body 102. Transparent optic holder 110 supports optic 108. For example, optic 108 may be snapped in to connect to transparent optic holder 110 or may be secured to transparent optic holder 110 using other suitable fastening means such as an adhesive or hardware (not shown). Transparent optic holder 110 has an outer circumference substantially equal to a circumference of the first end or top of lamp body 102 and an inner circumference substantially equal to a circumference of optic 108. In one example, optic 108 and transparent optic holder 110 are manufactured as a single assembly and therefore do not require coupling.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of example aspects of the present disclosure thereof, and while the example aspects have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. An LED lamp comprising:

an LED assembly comprising a plurality of LEDs;

a circular base plate in thermal communication with the LED assembly;

an electrical module electrically coupled to the LED assembly and configured to supply power to the LED assembly;

a lamp body coupled to and in thermal communication to transfer heat from the base plate at a first end and concealing at least a portion of the electrical module at a second end, wherein the lamp body comprise a substantially smooth surface extending from the base plate to the electrical module, and wherein the smooth surface of the lamp body is exclusive of surface irregularities including holes and projections, and the lamp body is constructed of a material for dissipating heat;

an optic configured to disperse light generated by the LED assembly; and a transparent optic holder surrounding the optic, coupled to the first end of the lamp body, and configured to support the optic, the transparent optic holder having an outer circumference substantially equal to a circumference of the first end of the lamp body and an inner circumference substantially equal to a circumference of the optic.

2. The LED lamp of claim 1, wherein the circular base plate comprises a substantially flat center region and a sloping outer region.

3. The LED lamp of claim 1, wherein the circumference of the first end of the lamp body is greater than a circumference of the second end of the lamp body.

4. The LED lamp of claim 1, wherein the base plate is configured to snap into the lamp body.

5. The LED lamp of claim 1, wherein the electrical module is mechanically coupled to a bottom side of the circular base plate, opposite to the LED assembly.

6. The LED lamp of claim 1, wherein the base plate and lamp body comprise a single assembly.

7. The LED lamp of claim 1, wherein the optic and the transparent optic holder comprise a single assembly.

8. The LED lamp of claim 1, wherein the plurality of LEOs are disposed on the LED assembly substantially adjacent to one another.

9. The LED lamp of claim 1, wherein the base plate comprises a circumference substantially equal to the circumference of the first end of the lamp body.

10. The LED lamp of claim 1, wherein the second end of the lamp body comprises a circumference substantially equal to a circumference of the electrical module.

11. The LED lamp of claim 1, wherein the lamp body is configured to conceal at least a portion of the base plate, at least a portion of the electrical module, and electrical couplings between the electrical module and the LED assembly.

12. A PAR lamp, comprising:

an LED module comprising a plurality of LEDs;

an electrical module configured to supply power to the LED module;

a heat sink assembly comprising:

a thermally conductive base; and a smooth-surfaced thermally conductive body; wherein the LED module is in thermal communication to transfer heat from the thermally conductive base and is coupled to a first side of the thermally conductive base; wherein the electrical module is coupled to a second side of the thermally conductive base, opposite the LED module; and wherein the smooth-surfaced thermally conductive body is configured to extend the length of the heat sink, from the thermally conductive base to the electrical module, and to conceal at least a portion of the electrical module; and wherein the smooth surface of the lamp body is exclusive of surface irregularities including holes and projections; and the lamp body is constructed of a material for dissipating heat; and an optic module coupled to the first side of the smooth-surfaced thermally conductive body and having an outer circumference substantially equal to a circumference of the first side of the smooth-surfaced thermally conductive body, the optic module comprising:

an optic configured to disperse light generated by the LED module; and a transparent ring surrounding the optic.

13. The PAR lamp of claim 12, wherein the thermally conductive base comprises a substantially flat center region depressed into the smooth-surfaced thermally conductive body and a sloping outer region sloping upward away from the substantially flat center region and towards the end of the smooth-surfaced thermally conductive body.

14. The PAR lamp of claim 12, wherein the circumference of a first end of the smooth-surfaced thermally conductive body is greater than a circumference of the second end of the smooth-surfaced thermally conductive body.

15. The PAR lamp of claim 12, wherein the plurality of LEDs are disposed on the LED assembly substantially adjacent to one another.

* * * * *